US010683729B2

(12) United States Patent
Silva

(10) Patent No.: US 10,683,729 B2
(45) Date of Patent: Jun. 16, 2020

(54) SELECTIVE ROTATIONALLY ALIGNING INDICATING MECHANISM

(71) Applicant: Baker Hughes, a GE Company, LLC, Houston, TX (US)

(72) Inventor: Zachary S. Silva, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 376 days.

(21) Appl. No.: 15/680,156

(22) Filed: Aug. 17, 2017

(65) Prior Publication Data

US 2018/0023370 A1 Jan. 25, 2018

Related U.S. Application Data

(63) Continuation-in-part of application No. 14/489,694, filed on Sep. 18, 2014, now Pat. No. 9,932,823.

(51) Int. Cl.

| | |
|---|---|
| ***E21B 34/12*** | (2006.01) |
| ***E21B 23/00*** | (2006.01) |
| ***E21B 47/09*** | (2012.01) |
| *E21B 34/00* | (2006.01) |
| *E21B 33/13* | (2006.01) |
| *E21B 37/00* | (2006.01) |
| *E21B 43/04* | (2006.01) |
| *E21B 43/24* | (2006.01) |
| *E21B 43/25* | (2006.01) |

(Continued)

(52) U.S. Cl.

CPC ..... *E21B 34/12* (2013.01); *E21B 23/006* (2013.01); *E21B 47/09* (2013.01); *E21B 33/13* (2013.01); *E21B 37/00* (2013.01); *E21B 43/04* (2013.01); *E21B 43/20* (2013.01); *E21B 43/24* (2013.01); *E21B 43/25* (2013.01); *E21B 43/26* (2013.01); *E21B 2034/007* (2013.01)

(58) Field of Classification Search

CPC ..... E21B 34/12; E21B 23/006; E21B 47/09; E21B 33/13; E21B 37/00; E21B 43/04; E21B 43/20; E21B 43/24; E21B 43/25; E21B 2034/007; E21B 43/26

See application file for complete search history.

(56) References Cited

U.S. PATENT DOCUMENTS 6,382,319 B1 5/2002 Hill, Jr. et al.
6,464,006 B2 10/2002 Womble (Continued)

*Primary Examiner* — Robert E Fuller
*Assistant Examiner* — Christopher J Sebesta
(74) *Attorney, Agent, or Firm* — Shawn Hunter

(57) ABSTRACT

A multi-function tool is connected to an inner string to selectively align a port or ports in the inner string with ports in the outer string at various locations. The tool is locked from functioning at some locations where a locating collet will not selectively engage with an unlocking profile. In this more the tool will pass through the location unhindered. If an unlock profile is engaged the tool is enabled to be unlocked so that manipulation allows a support mandrel to align with collets that have an external V-shaped profile. Setting down weight allows the supported V-shaped profile on the collets engage a similar profile on the outer tubular to rotate, if needed, and to find support on a V-shaped profile on the surrounding tubular for performance of the borehole operation. Thereafter the locating collet engages a locking profile to disable the tool again.

18 Claims, 15 Drawing Sheets

(51) Int. Cl.
*E21B 43/26* (2006.01)
*E21B 43/20* (2006.01)

(56) References Cited

U.S. PATENT DOCUMENTS

| | | | | |
|---|---|---|---|---|
| 2002/0117301 | A1* | 8/2002 | Womble | E21B 43/045<br>166/278 |
| 2007/0295514 | A1* | 12/2007 | Rohde | E21B 43/12<br>166/386 |
| 2011/0067862 | A1* | 3/2011 | Clem | E21B 43/045<br>166/278 |
| 2012/0048556 | A1* | 3/2012 | O'Connell | E21B 23/006<br>166/308.1 |
| 2014/0014360 | A1* | 1/2014 | Wilson | E21B 21/103<br>166/373 |
| 2016/0084027 | A1 | 3/2016 | Silva et al. | |

* cited by examiner

SELECTIVE ROTATIONALLY ALIGNING INDICATING MECHANISM

This application is a continuation-in-part of U.S. application Ser. No. 14/489,694 filed Sep. 18, 2014 and published as US 2016/0084027.

FIELD OF THE INVENTION

The field of the invention is a tool inner string that can be run through an outer string and in specific predetermined locations the tool can be unlocked to find set down support and tool rotational orientation with an outer string port. The tool can be locked to not find support in passing through other zones. Once unlocked to operate using an indexing device setting down weight allows rotation for needed alignment and a support location of the inner string to the outer string at multiple locations.

BACKGROUND OF THE INVENTION

With the advances of downhole completion and well monitoring methods, rotationally aligning service strings are beginning to see a growing number of applications for their use. Current generation rotationally aligned equipment, in the form of well monitoring wet connects, are commonly positioned at the top of a lower completion to allow a monitor from the lower completion to be linked to surface equipment. However, these rotational aligned connections are limited to single point in the tool string. Additionally, downhole completion frac pack methods are limited to linear alignment only of a service string to an outer string in current generation completion systems. This introduces difficulties in ways to control erosive flow paths and implement optimal alignment of tool strings to ensure durability for the applicable frac tools. Multizone completions are equally limited in the inability to rotationally align a frac tool with each frac sleeve over the course of several zones. Additionally, deep water completions require the use of indicating tools to identify tool, port, or seal position and prevent unwanted tool movement caused by tubing stretch, rig heave, etc. A common indicator for tool position is a hard boundary encountered by the indicating tool through interaction with a unique profile on the ID of the outer string, which can allow for either setting down weight or pulling on the rental string while the indicating tool is in "Locate Mode." Manipulation of the indicating tool with an associated profile can be used to cycle the indicating tool to the "Snap Thru Mode," enabling the rental string to pass beyond the indicating profile. For multi-zone systems, this produces the need to indicate on and cycle through each profile of each subsequent zone, resulting in excess string manipulation when passing through or between zones. This invention provides an apparatus to selectively lock rotationally aligning indicating tools in the "Snap Thru Mode" while tripping both in and out of the lower completion, to allow movement through multiple zones without having to index the mechanism and to provide a positive no-go indication in the axial and rotational direction when each indication boundary is encountered in order to service multiple zones with rotationally aligning equipment.

A tool that selectively unlocks after landing collets in a profile and using a pickup force and spring return to advance a j-slot to selectively align locking dogs with an axial groove has been described in US 2016/0084027, and is fully incorporated by reference herein as if fully set forth. In this tool the tool is functional for a downhole operation when the dogs rotate into alignment with an axial slot due to picking up against a spring return force while operating a j-slot. After the operation is completed the spring-loaded collets align with another profile and picking up against the spring force rotates a sleeve having the j-slot so that the locking dogs are again aligned axially with stops between the axial slots so that the inner string is locked against relative movement and can pass to the next zone of interest or out of the hole without needing to be cycled at other locations.

Selectively supported collet fingers made from axial slices into a tube and having an exterior profile on each finger to engage a similar profile in a surround tubular have been made by Baker Hughes, a GE company under the trademark Smart Collet® and the makeup and operation of such collets is described in U.S. Pat. Nos. 6,382,319 and 6,464,006 and is fully incorporated by reference herein as if fully set forth.

The present invention combines the selective locking of a tool with spaced profiles in a surrounding tubular as described in US 2016/0084027 with a Smart Collet® with finger profiles on adjacent fingers defining a V-shaped protruding shape to engage a similarly shaped profile on the outer tubular. The V-shapes create relative rotation, if needed for alignment of ports between the inner string and the outer string, for example. Freeing the tool to operate after passing the first profile using a lower j-slot to align dogs with an axial slot allows a j-slot at the upper end of the tool to position a support mandrel with a similar V-shaped profile in alignment with the V-shaped profile on the Smart Collet® fingers so that as the inner string is set down the V-shaped pattern of the collet fingers is supported as rotation, if needed, occurs on setting down weight to land on a V-shaped support profile in the surrounding tubular. After performing the downhole operation such as a gravel pack or a fracturing operation, for example, the tool is picked up through another profile and locked again for transport to another unlock profile where the steps can be repeated or out of the borehole. Certain locations where the unlocking collets do not fit in the outer string profile allow the tool to be pulled past without actuation. Rotational orientation is enabled in a variety of locations as opposed to single location functionality of known wet connect devices.

SUMMARY OF THE INVENTION

A multi-function tool is connected to an inner string to selectively align a port or ports in the inner string with ports in the outer string at various locations. The tool is locked from functioning at some locations where a locating collet will not selectively engage with an unlocking profile. In this more the tool will pass through the location unhindered. If an unlock profile is engaged the tool is enabled to be unlocked so that manipulation allows a support mandrel to align with collets that have an external V-shaped profile. Setting down weight allows the supported V-shaped profile on the collets engage a similar profile on the outer tubular to rotate, if needed, and to find support on a V-shaped profile on the surrounding tubular for performance of the borehole operation. Thereafter the locating collet engages a locking profile to disable the tool again.

BRIEF DESCRIPTION OF THE DRAWINGS

FIGS. 6*a*-6*e* are the view of FIGS. 5*a*-5*c* with the tool pulled out of an upper profile which locks the tool from actuation until another unlock profile, if any, is engaged;

DETAILED DESCRIPTION OF THE PREFERRED EMBODIMENT

Figure 1A:
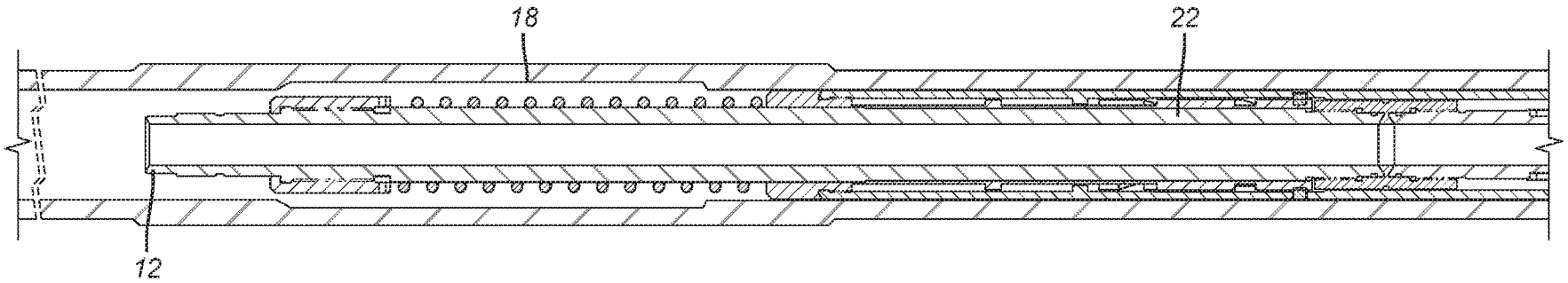
FIGS. 1*a*-1*c* are the tool in the locked position for running in and engaged to an unlocking profile in the outer housing.
Figure 1B:
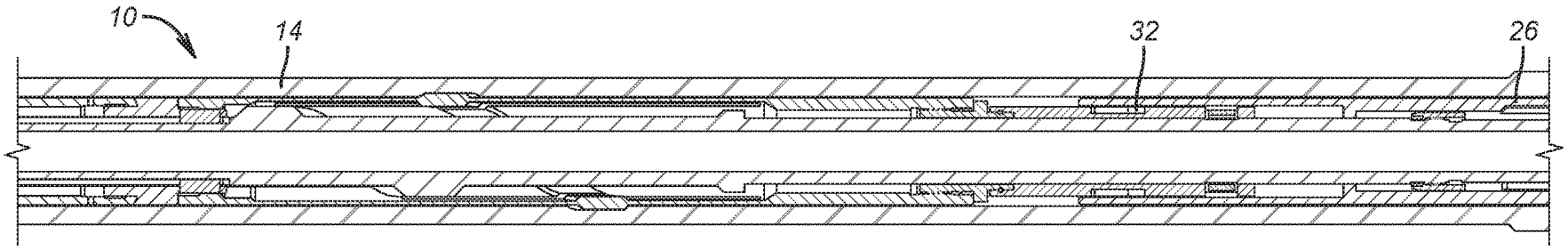
Figure 1C:
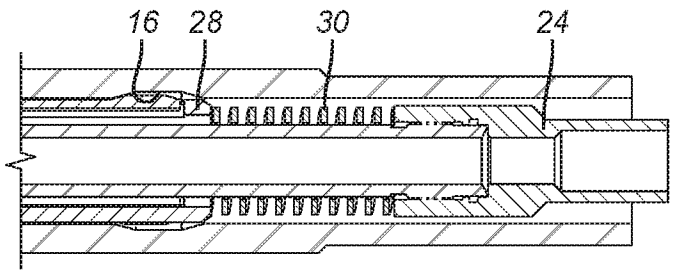
Figure 5A:
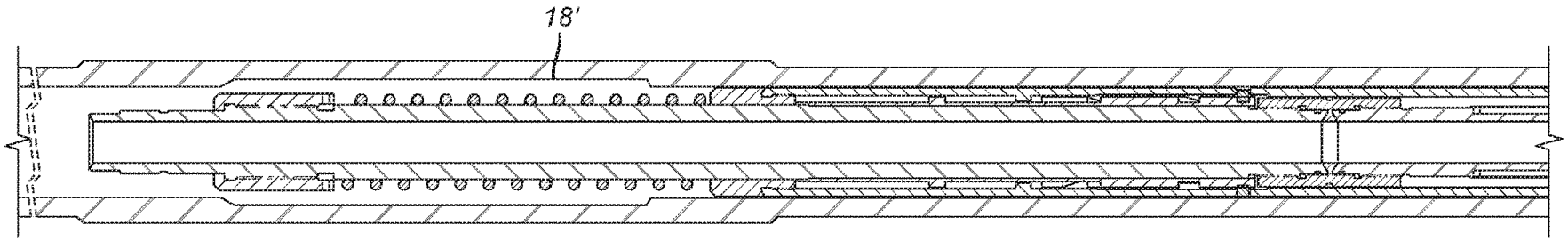
FIGS. 5*a*-5*c* are the view of FIGS. 4*a*-4*c* showing a pickup force after landing in an upper profile to unsupport the upper collets.
Figure 5B:
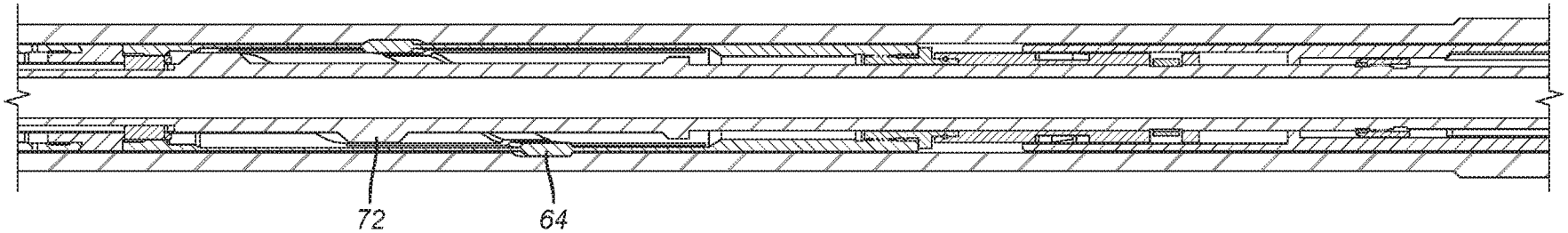
Figure 6B:
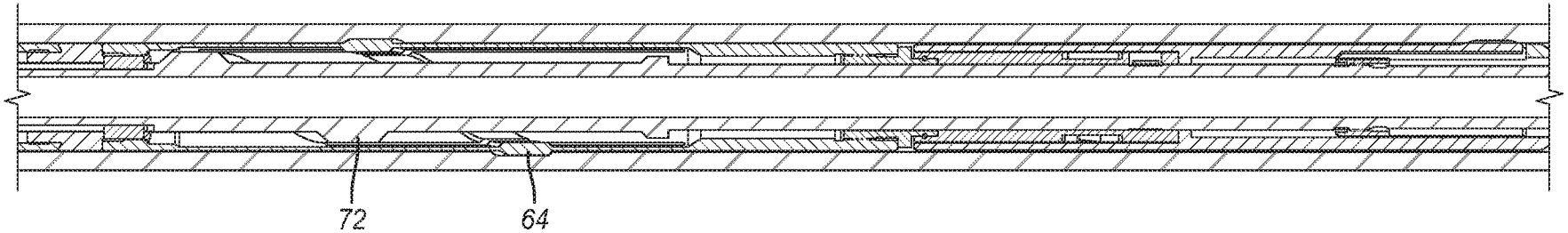
Figure 5C:
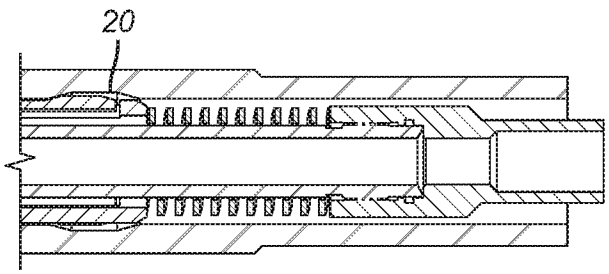
Figure 6C:
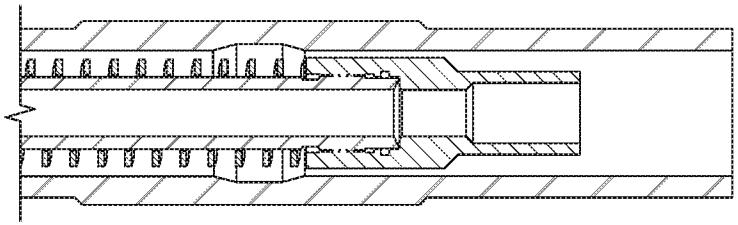
Figure 8:
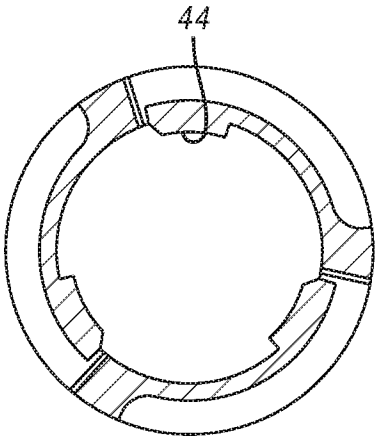
FIG. 8 is a section view through line 8-8 of FIG. 7.

Referring to FIGS. 1*a*-1*c*, the tool 10 is connected at upper end 12 to an inner string that is not shown. An outer string 14 is fixedly mounted in a borehole that is also not shown. The outer string can have a series of spaced apart openings to the formation that are also not shown. Each such opening has an unlock profile 16 below a support profile 18 and a relock profile 20 above support profile 18. It should be noted that relock profile 20 is shown in FIG. 5*c* as aligned with unlock profile 16 for drawing convenience but in reality relock profile 20 is axially uphole from unlock profile 16 and below the next uphole support profile schematically shown as 18'. In essence the pattern going uphole is an unlock profile 16 followed by a support profile 18 followed by a relock profile 20. In that manner if the tool 10 is releasably captured in an unlock profile 16 then it will operate to find support and rotational alignment off the next support profile 18 and then relock at relock profile 20 that follows immediately above the support profile 18 just exited. In this manner the tool 10 can bypass some support profiles, for example 18' if there is no engagement at a leading unlock profile before the support profile 18'. One the other hand if there is releasable engagement with a given unlock profile such as 16 then the tool 10 can be actuated for support and rotational alignment with spaced ports that are not shown in the outer string 14. Before even delving into the detailed operation of tool 10 some immediate advantages of the tool 10 can already be appreciated. Axial and rotational alignment of unshown ports on the inner string that supports tool 10 can be axially and rotationally aligned with selected unshown ports on the outer string 14 at different depths. Some locations can be simply skipped if the tool 10 fails to engage an unlock profile such as 16. In the latter case the tool 10 remains locked as it passes a port location on an outer string, for example.

Figure 7:
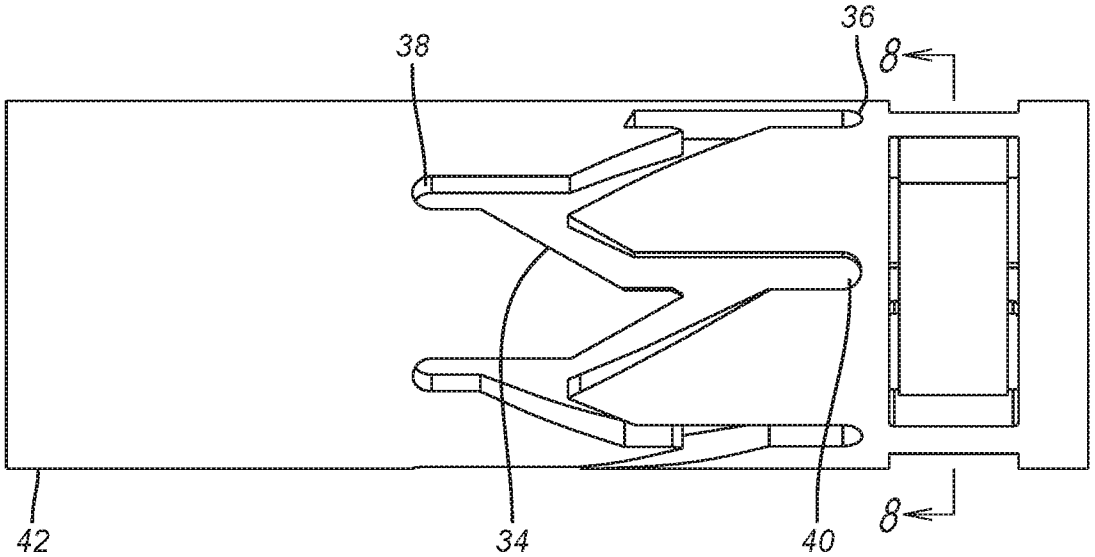
FIG. 7 is an exterior view of the lower j-slot sleeve with circumferentially mounted locking dogs.
Figure 12A:
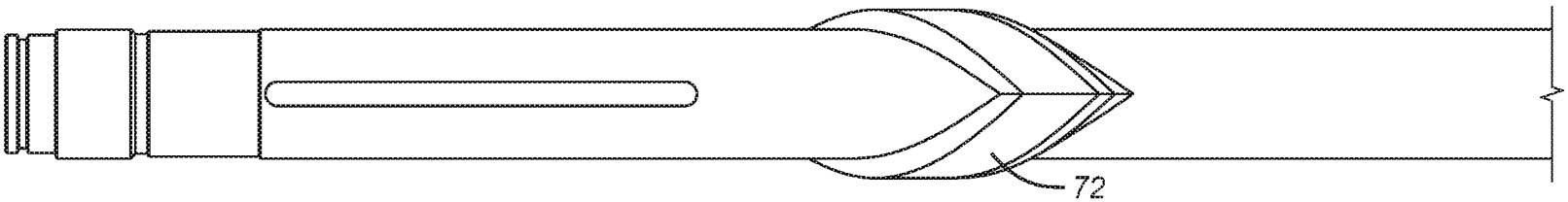
FIGS. 12*a*-12*b* show a V-shape profile on a support mandrel that selective aligns within the V-shape in FIG. 9.
Figure 12B:
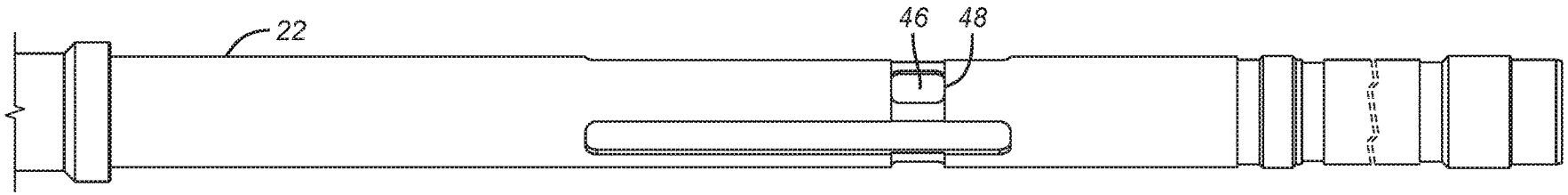
Figure 13B:
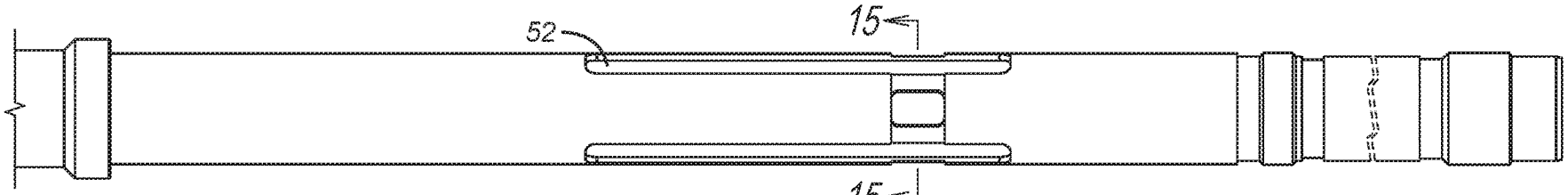
Figure 14B:
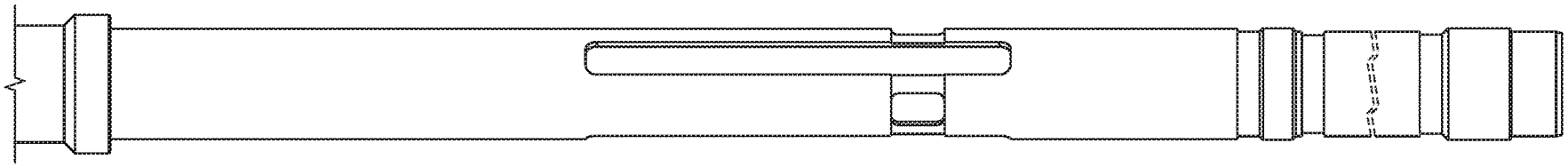
Figure 15:
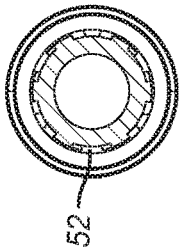
FIG. 15 is a section through line 15-15 of FIG. 13*b*.

The initial step is to unlock the tool 10 at a desired location. Tool 10 has a mandrel 22 that extends from upper end 12 to bottom sub 24. The outer assembly extends from spring 74 to spring 30 and includes all the intervening parts that surround the mandrel 22 which can be in multiple parts, as shown. Referring to FIGS. 1*b*-1*c*, a series of collets 26 overlay collet support 28 so that at a predetermined unlock profile 16 where engagement is contemplated as in FIG. 1*c* the mandrel 22 will be lowered past unlock profile 16 and then picked up to allow the collets 26 to engage the unlock profile 16. Spring 30 assists in snapping the collets 26 into the unlock profile 16. Pin 32 moves with mandrel 22 in j-slot track 34 of j-slot sleeve 36 shown in FIG. 7. With collets 26 in unlock profile 16 and a pickup force applied to mandrel 22, the spring 30 is compressed. The pin 32 moves from j-slot position 36 to position 38 as spring 30 is compressed. When collets 26 jump out of unlock profile 16 the spring 30 advances the pin 32 from position 38 to position 40 of the j-slot pattern 34. The result of this is rotation of j-slot sleeve 42. A circumferential array of dogs 44 also get rotated with sleeve 42 out of depressions 46 in mandrel 22 as shown in FIG. 12*b* where surfaces 48 and 50 prevent axial movement of mandrel 22 and into longitudinal slot 52 to allow axial movement of mandrel 22. Later on after support and alignment for tool 10 is found at support profile 18 engagement of collets 26 in unlock profile 20 will continue the rotation of j-slot sleeve 42 to put the dogs 44 back into the next adjacent set of depressions 46 in the direction of j-slot sleeve 42 rotation. This will happen by the continuing relative movement between the pin 32 and the j-slot track 34.

Figure 2A:
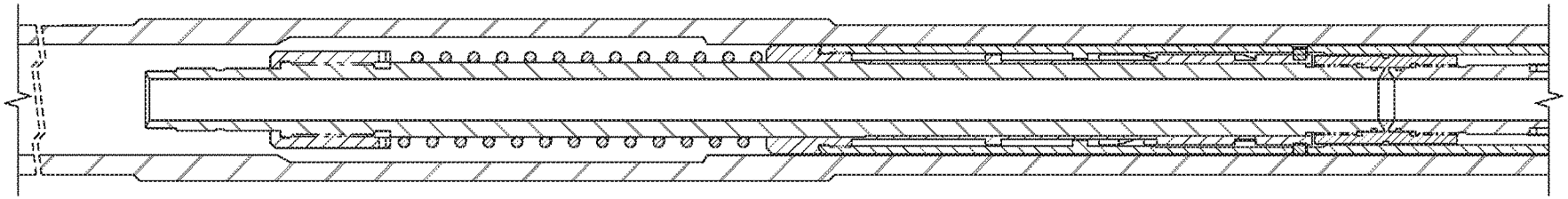
FIGS. 2*a*-2*c* is the view of FIGS. 1*a*-1*c* with the tool picked up so that a lower j-slot unlocks the tool on an inner string for reconfiguration.
Figure 2B:
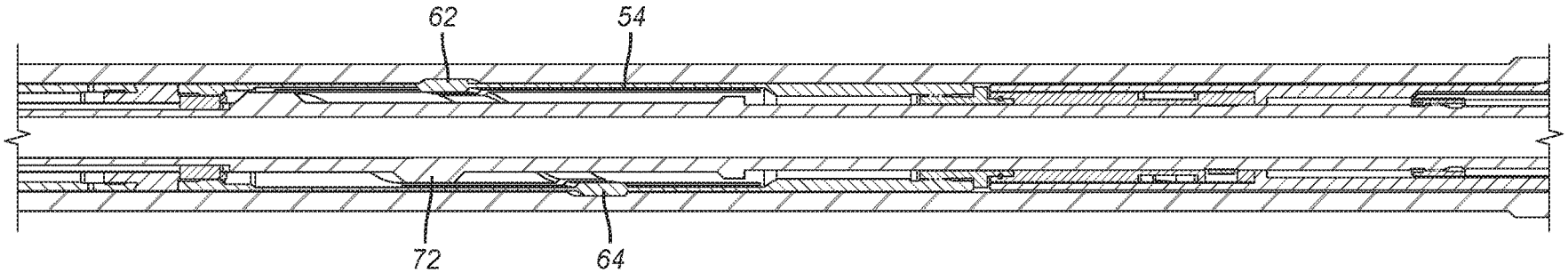
Figure 2C:
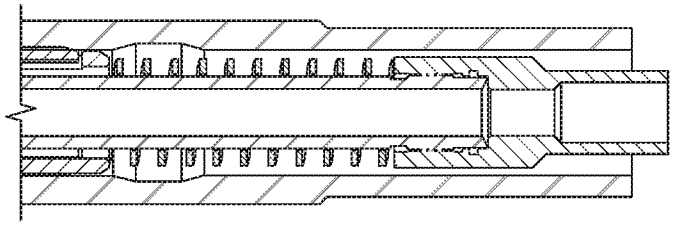
Figure 4A:
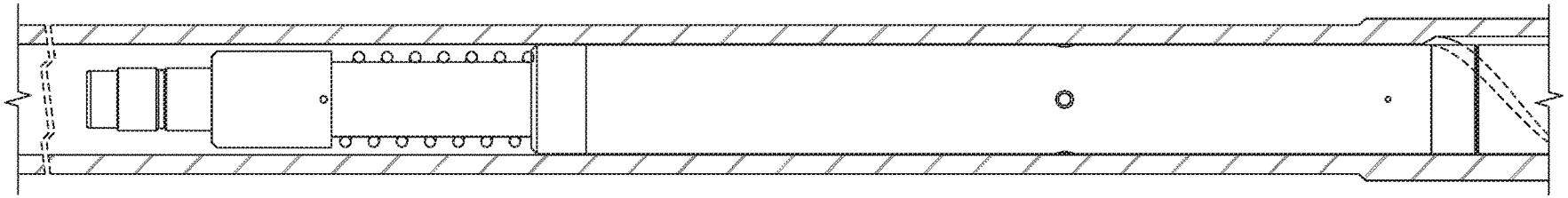
FIGS. 4*a*-4*c* are the view of FIGS. 3*a*-3*c* with the upper collets rotated and landed in the profile of the surrounding housing.

FIGS. 2*a*-2*c* show the unlocked position just described before a pickup force is applied. Before discussing this movement, additional components of the tool need to be described. The above described mode of unlocking and locking was described in detail in US 2016/0084027, which is incorporated herein as if fully set forth.

Figure 9:
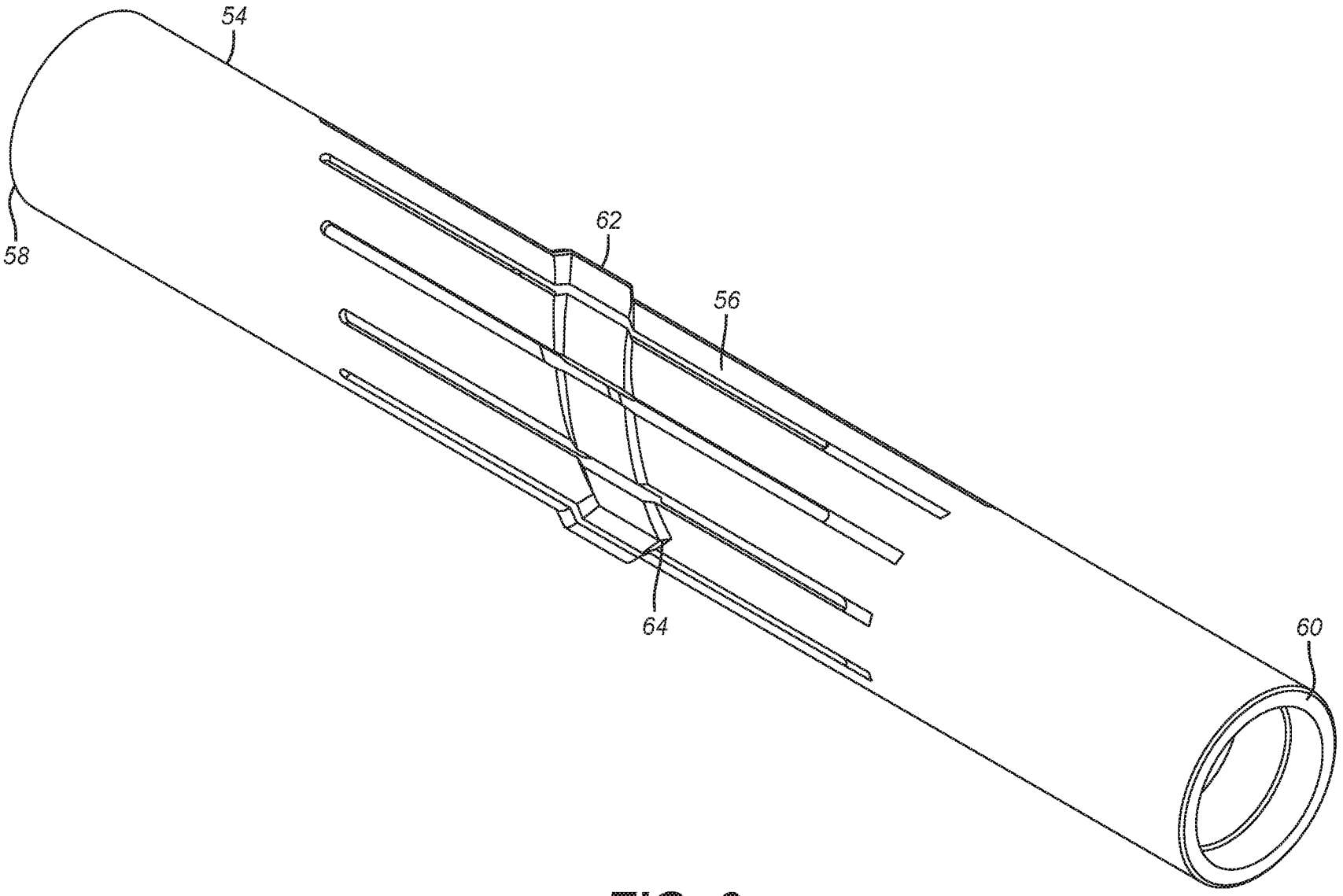
FIG. 9 is a perspective view of the upper collet sleeve showing the lower V-shaped profile on the collet fingers.
Figure 10:
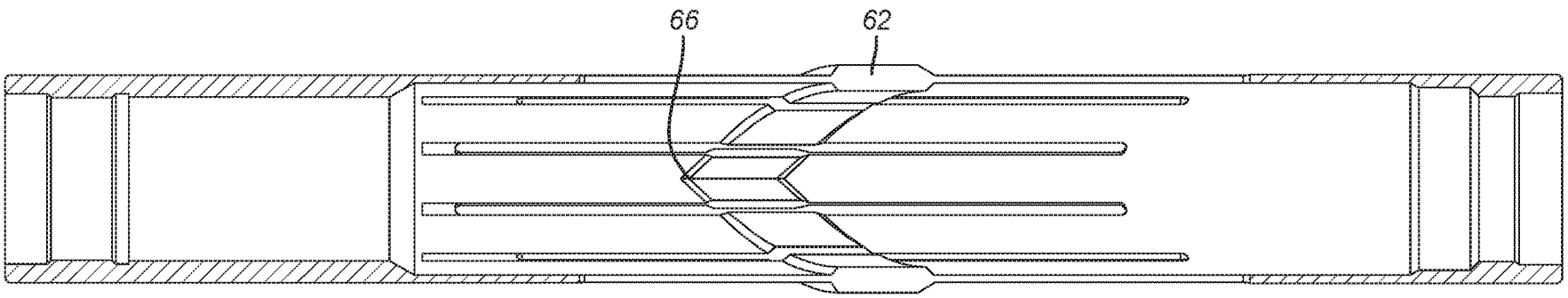
FIG. 10 is a longitudinal section view through the sleeve of FIG. 9 showing an upper V-shape on the collet fingers.
Figure 11:
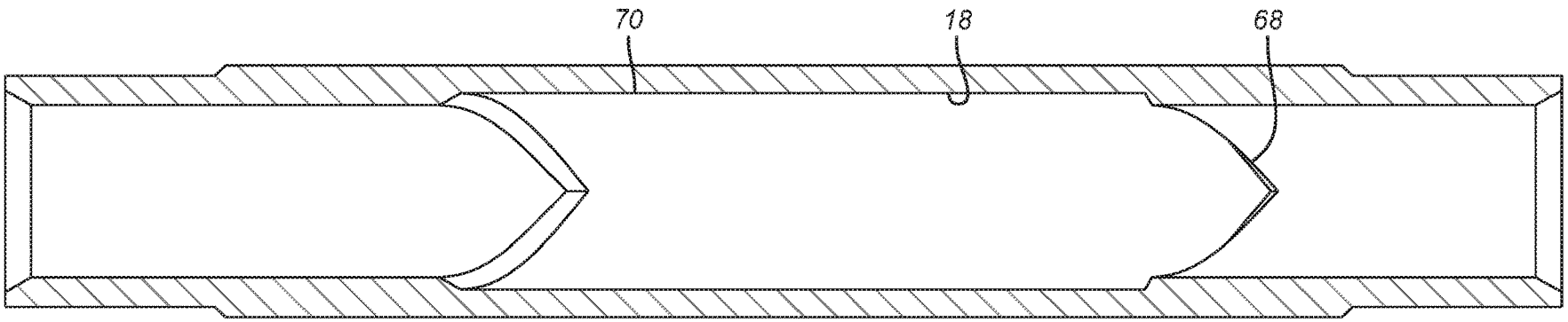
FIG. 11 is a section view through an outer housing on an outer string with a landing profile that accepts the V-shape of FIG. 9.
Figure 13A:
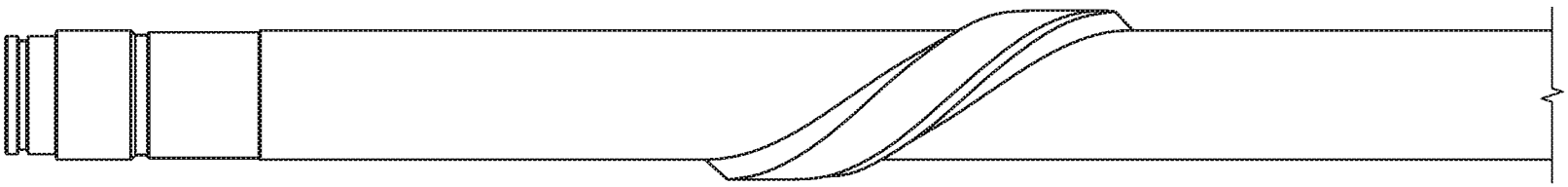
FIGS. 13*a*-13*b* is a rotated view of FIGS. 12*a*-12*b* showing the dogs aligned with an axial slot for unlocking the tool for axial movement.
Figure 14A:
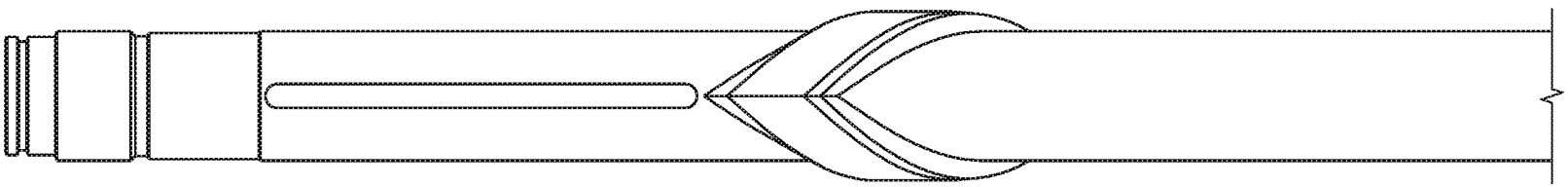
FIGS. 14*a*-14*b* are the rotated view of FIGS. 13*a*-13*b* showing the dogs locked by being misaligned with the axial slot and the V-shaped profile misaligned with the V-shaped profile of the fingers on the upper collet.

A support collet sleeve 54 is shown in FIG. 2*b* and in more detail in FIGS. 9 and 10. It has a series of fingers 56 extending part way between ends 58 and 60. There is a profile member 62 on each finger 56 that extends to inside and outside each finger 56 as seen in section in FIG. 10. In essence the profile members 62 are two connected half spiral patterns to form a downhole oriented V-shape 64 and an uphole oriented V-shape 66. The outer string 14 has a support profile 18 seen in more detail in FIG. 11. Support profile 18 has an uphole oriented V-shaped support surface 68 with which V-shape 64 will engage when mandrel 22 is set down. Other mating shapes that induce rotation to a predetermined alignment can be used such as U-shapes or other shapes. If V-shape 64 is initially misaligned with V-shape 68 then relative rotation will ensue between collet sleeve 54 and support profile 18, which is held fixed to the outer string 14. If there is perfect alignment of V-shaped profiles 64 and 68 there will only be relative axial movement between the collet sleeve 54 and the support profile 18 which is fixed as the mandrel 22 is set down.

The fingers 56 are flexible and the profile members 62 will snap into recess 70 that in part defines the support profile 18. However, merely snapping into recess 70 by profile members 62 that make up the V-shape 64 will alone not be sufficient to support the tool 10 on profile 68. The V-shape 64 will need internal support from V-shape 72 on mandrel 22 before landing on V-shape 68 in support profile 18. In FIG. 2*c* the V-shaped profiles 64 and 72 are axially offset.

Figure 3A:
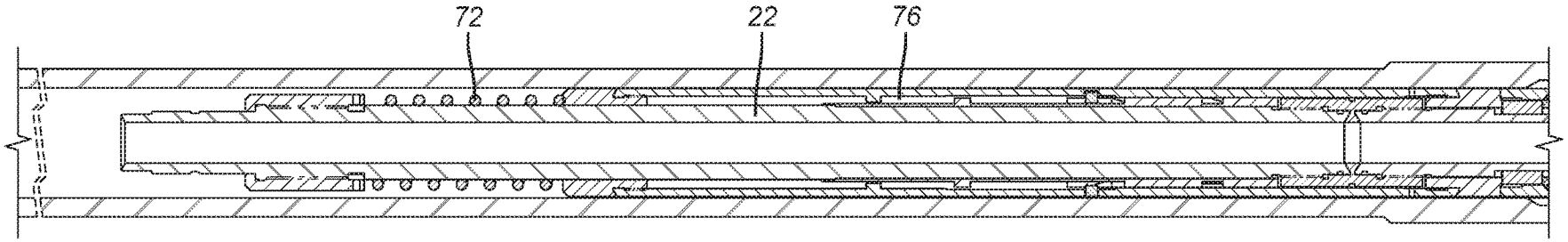
FIGS. 3*a*-3*c* are the view of FIGS. 2*a*-2*c* showing setting down to allow the upper collets to enter an alignment profile in the outer housing.
Figure 3B:
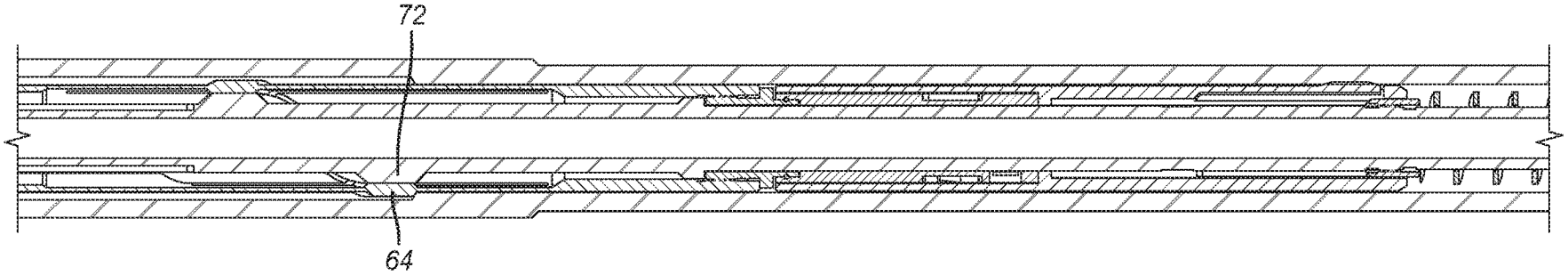
Figure 4B:
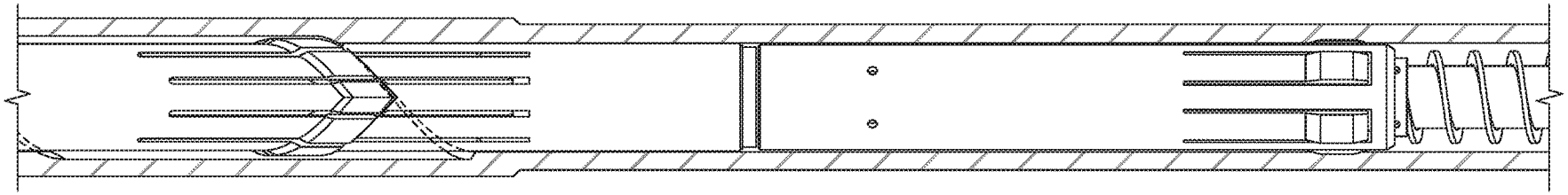
Figure 3C:
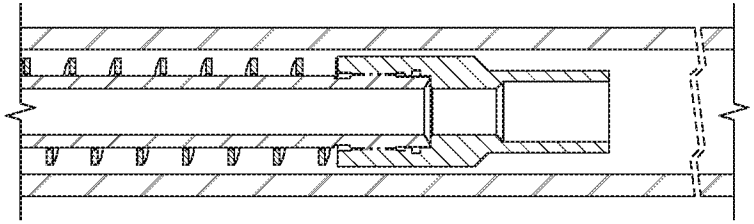
Figure 4C:
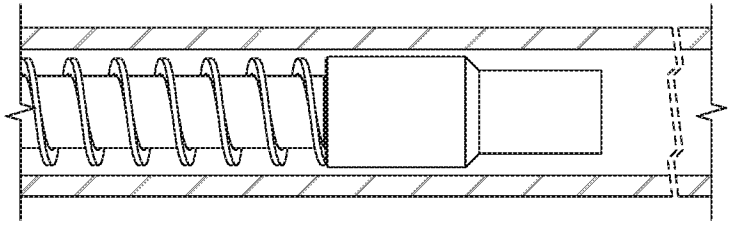
Figure 6A:
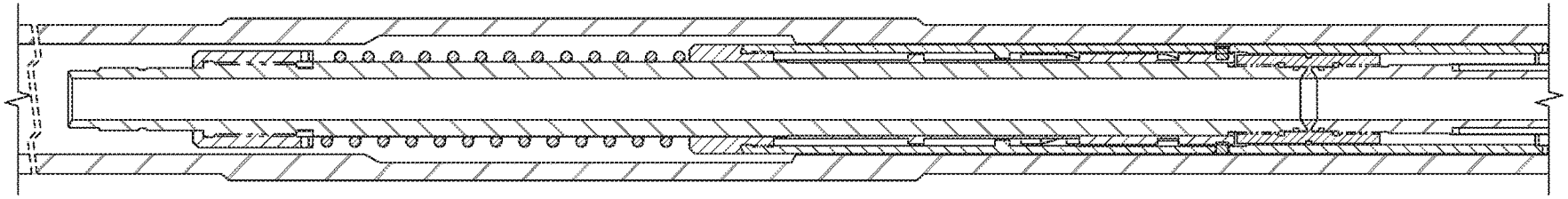

However in FIG. 3*b* they have come into alignment. They way this happens is that the V-shape 64 makes contact with V-shape 68 and has enough outward force built into fingers 56 to hold the V-shape 64 against the V-shape 68 as weight is set down to compress spring 74 as an upper j-slot assembly 76 is operated to allow mandrel 22 to axially descend to align V-shape 72 with V-shape 64 as V-shape 64 is resting on V-shape 68. At this point the tool 10 is fully supported on V-shape 68 using V-shape 64 internally supported by V-shape 72 on mandrel 22. The tool 10 is now in the FIG. 4*b* position. The ports that are not shown between the inner string and the outer string 14 are in alignment and a procedure such as gravel packing or fracturing, for example, can take place. When that procedure ends the mandrel 22 is lifted and spring 74 in conjunction with the upper j-slot 76 allow for an axial offset between supporting V-shape 72 and V-shape 64 on fingers 56. This is illustrated in FIG. 5*b*.

What remains is the need to relock the tool after lifting the V-shape 64 out of recess 70 and leaving V-shape 64 without internal support so that fingers 56 can flex radially inwardly without engaging for support into any other support profiles, such as for example 18'. Picking up the mandrel 22 will land the collets 28 in a relock profile such as 20 where the j-slot sleeve 42 will again be rotated in a manner previously described to put the locking dogs 44 into recess 46 and out of alignment with slot 52 thereby locking the collets 26 against relative movement with respect to mandrel 22. Going uphole with tool 10 will leave the tool locked until the tool 10 comes out of the hole or until another unlock profile such as 16 is engaged and the process is repeated. The selective support function of the V-shape 64 functions similarly to a Smart Collet® as described in U.S. Pat. Nos. 6,382,319 and 6,464,006 and is fully incorporated by reference herein as if fully set forth.

In essence tool 10 combines the ability to be locked and selectively unlocked at unlock profile locations and in between the tool simple snaps through any surrounding surface recesses without actuation. When unlocked the tool combines the capability of axial support to align openings axially between an inner and outer string as well as a rotational alignment capability to rotationally align ports in and inner and an outer string. Such axial and rotational alignment can occur more than once in a single trip in the borehole depending on how many unlock and relock profiles are distributed in the outer string.

While port alignment is a principal function of the tool 10, other purposes of the tool that finds support in select locations and auto-rotates for rotational alignment are also envisioned for a variety of borehole treatment procedures and other tasks as outlined below.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, gravel packing, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

I claim:

1. A borehole tool selectively supported and rotationally oriented within an outer tubular string defining a borehole wall for alignment of at least one port on the borehole tool with at least one port on the outer tubular string, comprising:

a mandrel;

an outer assembly on said mandrel comprising selectively supported finger collets, said finger collets comprising a selectively rotation inducing profile when contacting a similarly shaped support profile on the outer tubular for rotation relative thereto, said selective supporting occurring with relative movement of said mandrel with respect to said outer assembly, said relative movement enabled with at least one collet on said outer assembly landing in a mating unlock profile on the outer tubular and axial translation of said mandrel; and said rotation inducing profile comprises profile members on adjacent finger collets wherein some of the profile members on adjacent finger collets are arranged to be axially offset with respect to one another to collectively form a V or U shape.

2. The tool of claim 1, further comprising:

said relative movement disabled after being enabled with said at least one collet engaging a relocking profile disposed on an opposite side of the support profile from the unlock profile.

3. The tool of claim 1, wherein:

said axial translation of said mandrel removes at least one locking dog on said outer assembly from a mandrel recess and aligns said at least one dog with an axial groove on said mandrel to enable said axial translation of said mandrel.

4. The tool of claim 3, wherein:

said at least one dog is rotated with a j-slot, operatively engaged to said at least one collet, between said mandrel recess and said axial slot for respective locking and unlocking between said mandrel and said j-slot.

5. The tool of claim 1, wherein:

said rotation inducing profile and said support profile both comprise a V or U shape.

6. The tool of claim 1, wherein:

said rotation inducing profile cannot be supported in said mating profile unless said at least one collet first engages an unlock profile in said outer tubular.

7. The tool of claim 1, wherein:

said rotation inducing profile is supported in a plurality of said mating profiles in a single trip when said at least one collet first engages multiple unlock profiles in said outer tubular.

8. The tool of claim 1, wherein:

said rotation inducing profile passes by at least one mating profile without finding support if said at least one collet has not engaged an unlock profile associated with the passed by mating profile.

9. A method of aligning ports in a tool on an inner string with ports in a surrounding tubular string for performing a borehole treatment, comprising: providing a rotatable orientation feature on collet fingers on a sleeve that forms a part of an outer assembly surrounding a mandrel supported by an inner string, the orientation feature being a rotation inducing profile made up of profile members on adjacent finger collets wherein some of the profile members on adjacent finger collets are arranged to be axially offset with respect to one another to collectively form a V or U shape; engaging said orientation feature with at least one conforming support surface on the surrounding tubular string for selective relative rotation between the ports on said tool and the ports on said surrounding tubular string; enabling said orientation feature to support the tool and inner string weight on the conforming support surface with earlier enabling relative motion between said mandrel and said outer assembly, said earlier enabling said relative motion comprises disabling a lock between said mandrel and said outer assembly, said earlier enabling said relative motion comprises disabling a lock between said mandrel and said outer assembly; performing a borehole operation through said aligned ports.

10. The method of claim 9, comprising:

engaging at least one collet on said outer assembly to an unlock conforming profile on the surrounding tubular string;

operating a j-slot sleeve with movement of said mandrel to rotate at least one dog out of a conforming recess where relative movement between said mandrel and said outer assembly is prevented into an axial mandrel slot where relative movement between said mandrel and said outer assembly is permitted.

11. The method of claim 10, comprising:

performing a well treatment through said ports on the tool and the surrounding tubular string after alignment with said orientation feature and support of said orientation feature on said conforming support surface;

engaging said at least one collet with a relock profile after said performing;

advancing said at least one dog from said axial slot another conforming recess with said j-slot sleeve with mandrel movement to relock said outer assembly to said mandrel.

12. The method of claim 9, comprising:

shaping both said orientation feature and conforming support surface as a V-shape or a U-shape.

13. The method of claim 9, comprising:

engaging in a single trip said orientation feature on a plurality of spaced conforming support surfaces for support of said tool and said inner string by unlocking said lock each time before said orientation feature engages a conforming support surface.

14. The method of claim 9, comprising:

relocking said lock after each engagement of said orientation feature to a conforming support surface for support of said tool and said inner string.

15. The method of claim 14, comprising:

bypassing at least one said conforming support surface with said orientation feature without finding support for said tool and said inner string when said lock is locked.

16. The method of claim 9, comprising:

rotating said ports on said tool into a predetermined alignment with said ports on said surrounding tubular string by advancing said orientation feature into contact with said at least one conforming support surface.

17. The method of claim 9, comprising:

axially aligning said ports on said tool with said ports on said surrounding tubular string by fully advancing said orientation feature into contact with said at least one conforming support surface.

18. The method of claim 9, comprising:

said borehole operation comprises at least one of gravel packing, hydraulic fracturing, stimulation, tracer injection, cleaning, acidizing, steam injection, water flooding and cementing.

* * * * *